US006442905B1

(12) United States Patent
Weinstein

(10) Patent No.: US 6,442,905 B1
(45) Date of Patent: Sep. 3, 2002

(54) COMPLETE PRE-FABRICATED TILE COUNTER IN COMPONENTS

(76) Inventor: Albert I. Weinstein, 28710 Atford Dr., Rancho Palos Verdes, CA (US) 90275

( * ) Notice: Subject to any disclaimer, the term of this patent is extended or adjusted under 35 U.S.C. 154(b) by 0 days.

(21) Appl. No.: 09/650,110

(22) Filed: Aug. 29, 2000

Related U.S. Application Data

(63) Continuation of application No. 09/334,899, filed on Jun. 17, 1999, now Pat. No. 6,128,793.

(51) Int. Cl.[7] ..... A47K 1/04

(52) U.S. Cl. ..... 52/34; 52/35; 52/36; 52/408; 52/302; 4/631

(58) Field of Search ..... 52/34, 35, 408, 52/384; 4/631, 630, 637; 206/568, 223

(56) References Cited

U.S. PATENT DOCUMENTS 1,827,053 A 10/1931 Veneman
4,771,488 A * 9/1988 Markham ..... 4/631
4,894,272 A * 1/1990 Aisley ..... 428/156
5,253,932 A * 10/1993 Nesovic ..... 312/140.3
5,470,140 A * 11/1995 Schagunn ..... 312/140.3
5,722,746 A * 3/1998 Hull et al. ..... 312/140.3
5,816,005 A * 10/1998 Han ..... 52/391
5,979,133 A * 11/1999 Funkhouser ..... 52/408

FOREIGN PATENT DOCUMENTS

GB 2 003 419 A 3/1979

* cited by examiner

*Primary Examiner*—Carl D. Friedman
*Assistant Examiner*—Basil Katcheves
(74) *Attorney, Agent, or Firm*—Fulwider Patton Lee & Utecht

(57) ABSTRACT

A complete pre-fabricated tile counter is described that is already tiled and grouted and ready for installation upon a cabinet or other substructure, with or without a back splash or side splash panel. Counter tops including built-in sinks, and counters and splash panels may be produced economically in any style, shape and tile selected by a homeowner or builder prior to installation at a site. The invention counters are designed to be installed easily by the average homeowner or builders, in a minimum of time and with little mess to be cleaned up.

17 Claims, 4 Drawing Sheets

COMPLETE PRE-FABRICATED TILE COUNTER IN COMPONENTS

This application is a continuation of U.S. Ser. No. 09/334,899, entitled Complete Pre-fabricated Tile Counter in Components, now U.S. Pat. No. 6,128,793, filed Jun. 17, 1999 which is hereby incorporated by reference in its entirety.

BACKGROUND OF THE INVENTION

1. Field of the Invention

This invention relates to the installation of tiled counters in locations such as bathrooms and kitchens.

2. Background

At present, the installation of tiled counters is a messy, often difficult and time consuming work project, even when performed by experienced professionals. After the tiles have been selected and cost estimated, a skilled tile-setter has to come to the work site (kitchen or bathroom) and do the work. This work involves the use of many materials such as mortar, sheetrock or cement board, thinset and grout, leaving bits and pieces to be cleaned up.

The workmanship and quality of the installed counter is subject to the skill of the tile-setter, which is usually unknown to a homeowner at the time of contracting. If the homeowner finds the work to be shoddy or otherwise unsatisfactory, a dispute can arise that may be difficult to settle amicably. For builders who install counters in newly built houses, the problem is one of quality control as well as the installation time and cost. At present, even the smallest counter would take two days to complete.

Normally, a tile for a counter is first selected by the customer before installation and the customer must attempt to visualize what the completed product will look like. Such judgements are not easily made, sometimes leading to negative results where both customer and installer are disaffected, in this case, the customer usually has no choice but to live with the resulting installation although it may be unsatisfactory.

At present, even the smallest counter would take at least two days to complete by professional installers, causing unwelcome irradiation of homeowners. This installation time and cost is even more important in commercial applications.

There have been a number of approaches to casing the problems and difficulties inherent in the time honored methods of installing tiled counters and walls for a bathroom and kitchen. Some involve pre-fabrication of various parts. However, all still require considerable tiling work to be performed by a skilled person at the installation site. An example is a recently issued U.S. Pat. No. 5,816,005 by Han, who describes a pre-fabricated tiled panel.

For installing on a counter or wall, the panels have to be individually placed on a counter base or wall surface and each fastened in place before adding the next panel until all are completed. A number of tiles are left off each panel to allow for fastening the panel to a base or wall. The panel edge trim is also generally omitted from the prefabricated panel.

While the Han approach described above is definitely an improvement on the current industry wide methods, it still requires the services of a skilled tile setter on site to install and properly join the panels. He must also install the missing tiles described above and other tiling such as edge trim; all of which has to be done on site, leaving a mess to be cleaned up. Furthermore, the Han approach does not permit a customer to see what a finished counter will look like before installation and before the customer commits to a tiled configuration.

There remains a universal need by homeowners and building contractors to overcome the ongoing problems of cost, quality control, customer inconvenience and possible dissatisfaction that are inherent in the current methods of installing a tiled counter or other tiled portion.

SUMMARY OF THE INVENTION

The invention is a complete pre-fabricated tile counter top that is already tiled and grouted and ready for installation upon a cabinet or other substructure, with or without a back splash or side splash panel. The counter top and any splash panels would be done in any style, shape and tile desired and selected by a customer and could include sinks. No tiling of any sort need be done on the installation site. The counter top and splash panels can be produced economically and installed quickly on site, in a neat and orderly manner, requiring little installation skill.

One embodiment of the present invention is a prefabricated counter top for mounting on a cabinet and including at least one laminated substrate body having a base board member and a surface board member with a layer of adhesive sandwiched therebetween. The substrate body includes a top surface and at least one edge surface coated with an adhesive to which tiles are adhered thereto. The substrate body further includes a bottom surface for complementally mounting on the cabinet. After assembly, such counter top is transportable to the cabinet site to be installed thereon.

In another embodiment, a single layer slab is provided and includes a top surface and an edge surface coated with an adhesive to which tiles are directly adhered thereto. Such slab is typically formed of either a rigid foam polystyrene or rigid plastic material.

In yet another embodiment, a plurality of prefabricated counter top sections is provided to form a multi-sectional elongated counter top and a method for joining these sections is also described herein.

Embodiments of the invention can provide a complete, prefabricated tile counter plus splash panels capable of being installed easily and quickly by relatively unskilled persons. Furthermore, embodiments can provide a complete tiled counter that can be viewed by a customer prior to installation.

With advantage embodiments of the invention can also provide a complete tiled counter than can be produced in any shape, design, and tile color that meets a customer's requirement and preference.

Compared with existing methods, embodiments of the invention can be implemented at considerably lower costs with the further advantage of minimal installation time and minimal disruption at the installation site.

Another object is to provide a complete tiled counter that can be viewed by a customer prior to installation.

Yet another object is to provide a complete tiled counter that can produced in any shape, design and tile color that meets a customer's requirement and preference.

A major advantage of this invention over existing methods is its considerably lower cost.

Another advantage is its minimal installation time and thus minimal disruption at an installation site.

Further objects and advantages of the invention will be apparent from studying the following portion of the specification, the claims and the attached drawings.

Other features and advantages of the present invention will become more apparent from the following detailed description of the invention, when taken in conjunction with the accompanying exemplary drawings.

DESCRIPTION OF THE PREFERRED AND ALTERNATE EMBODIMENTS

Figure 1:
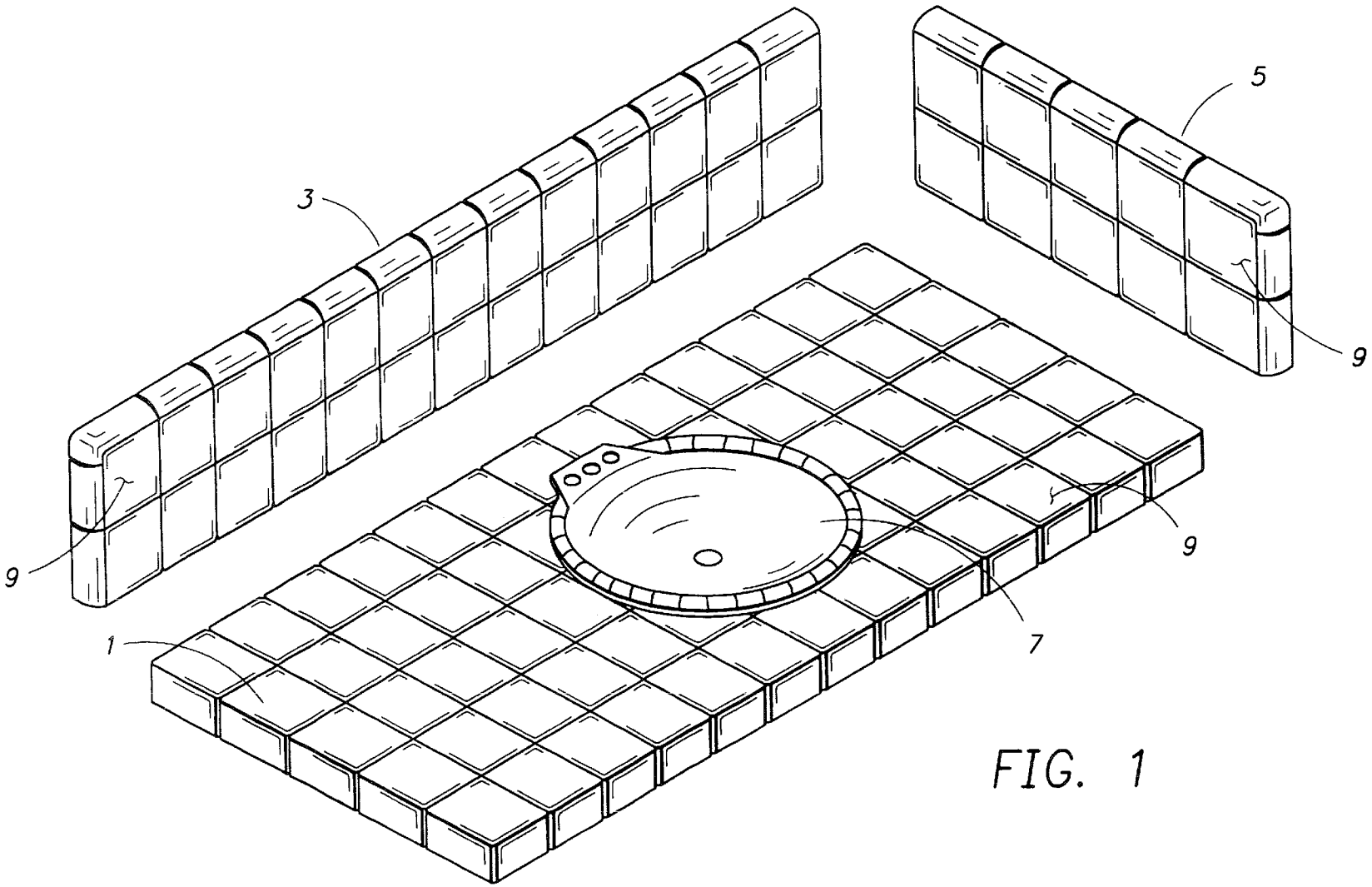
FIG. 1 is a perspective of a typical counter top and splash panels according to an embodiment of the present invention.

Referring particularly to the drawings, there is shown in FIG. 1 a perspective view of a typical complete tiled counter top 1, tiled back splash panel 3 and tiled side splash panel 5 according to the present invention, ready for installation at a site. A single inset sink 7 is shown included in the counter top 1. However, there may be more than one sink 7 included or none at all, leaving a blank top depending on the customer's requirements. A sink may also be inset as depicted in FIG. 1 or top set if so desired. Similarly, the tiles may be of any type, material, size and color, arranged in a pleasing design.

In practice, a number of different design counter tops would be produced, allowing a customer to view and select a counter top prior to installation. Counter tops may also be specially designed and fabricated to a customer's specification. This is particularly advantageous in cost and time for builders of design homes and other buildings requiring a few fixed counter designs in quantity.

In the following drawing figures to be discussed, some include features that are exaggerated in relative size. This has been done to ensure ease of understanding the invention construction as drawn, and should not be construed as being relative dimensions.

Figure 2:
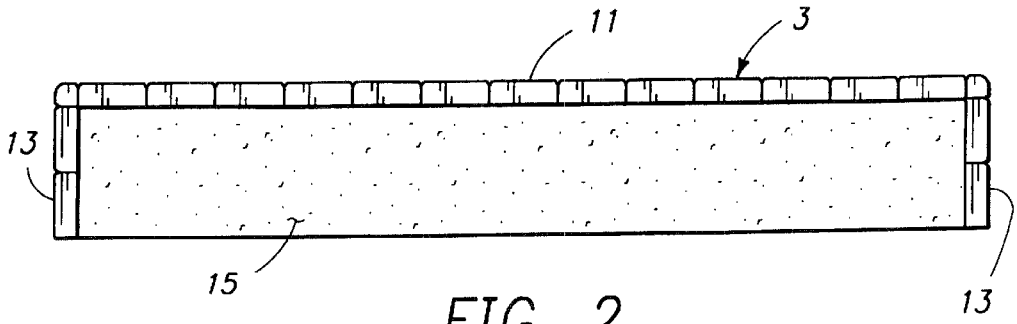
FIG. 2 is a back elevation view of a splash panel according to an embodiment of the present invention.
Figure 3:
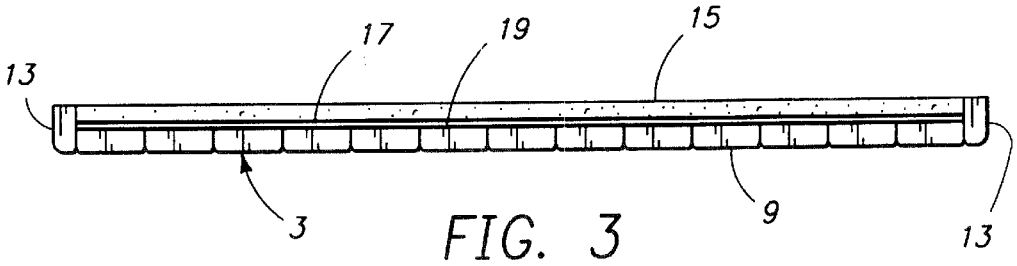
FIG. 3 is a bottom end view thereof, particularly showing the layers and components comprising a splash panel according to an embodiment of the present invention.

Refer now to FIGS. 2 and 3 which are respectively, a back view of a back splash panel 3 and a bottom end view of the panel. A side splash panel 5 is constructed identically to a back splash panel 5. Both splash panels are fabricated using a rigid back board 15 to which a layer or adhesive 17 such as thinset or mastic is spread and the front tiles 9, top edge trim tiles 11 and side edge trim tiles 13 are grouted and adhered thereto. If so desired, a splash panel would be installed after the counter top 1 was installed, in a manner in which the tile grout joints in the splash panel wold line up with the counter top 1. This is accomplished by applying a silicone or other caulking material to the back of the splash panel and pressing it to the wall while shimming the splash panel so as to provide a dimensional acceptable joint space between the counter top and the splash panel. In the event that there are adjacent back or side splash panels, there would be the same joint spacing between them as well, usually equal in size to a typical grout joint in the counter top 1. These joints would finally be caulked not grouted, in accordance with Tile Council of America standards after the panels have dried in place and the shims have been removed.

The splash panel back board 15 which serves as a base for the tiles, may be a cement board, green board, sheetrock, styrofoam, wood sheet, "Dens-Shield", or External Insulation and Finish Systems (EIFS) which is marketed under the trade name "DRYVIT". If a wood back board is used as the base, it will be necessary to add a waterproof membrane over the wood before adhering the tiles.

Any kind of tiles may be used to provide the splash board tiled surface. These include ceramic tiles, stone tiles, thin-brick tiles, quarry tiles, mosaic tiles, concrete tiles and simulated stones tiles, etc.. These tiles may also be used for tiling the counter top surfaces.

Figure 4:
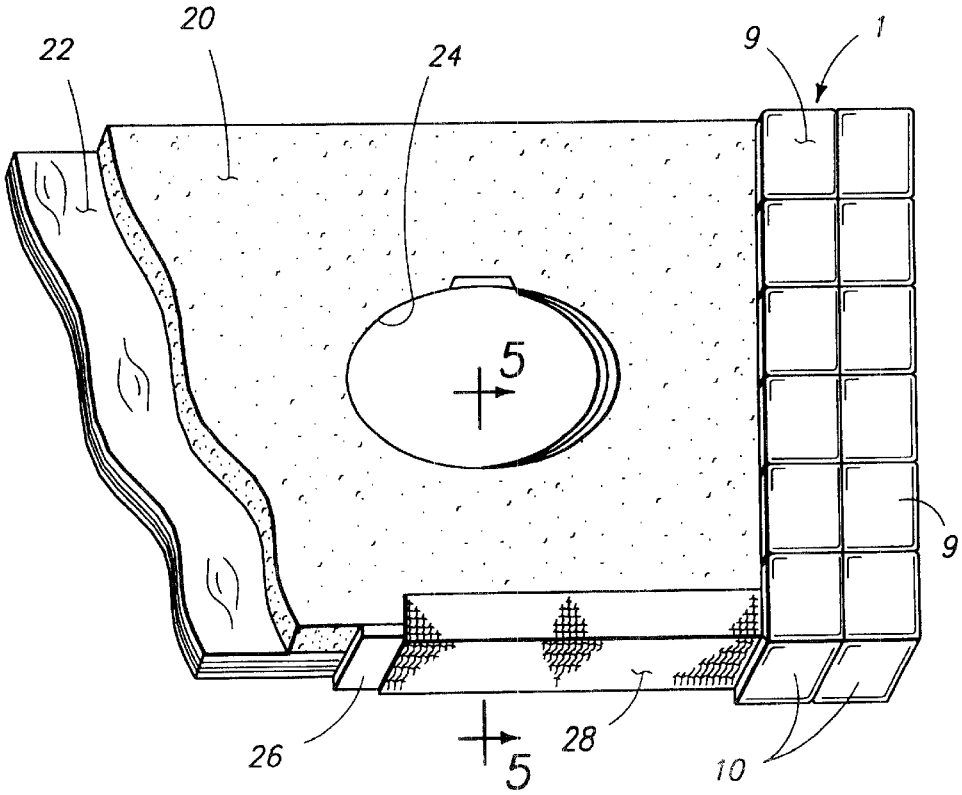
FIG. 4 is a top partial view of a counter top substrate according to an embodiment of the present invention, particularly showing some tiles installed and how the substrate open edges are covered prior to fastening tiles in place.

Referring now to FIG. 4, there is shown a partial top view of the substrate of a preferred embodiment counter top 1, with portions cut away showing the major components that form the substrate. These components are: a rigid top surface board 20, a rigid base board 22 which is bonded to the top surface board 20, three edge strip boards, one of which is located covering the front edge 26 and two side strips, and self adhesive drywall crack tape 28.

The counter top 1 is produced using the following steps:

1. A sheet of plywood or other rigid subpanel material is selected for the base board 22 and cut to the desired dimensions and shape to fit on a cabinet. A hole 24 for a sink is cut if a sink is required.
2. A surface board 20 is selected and cut to fit exactly over the base board 22. The surface board material may be cement board, greenboard, a rigid foam polystyrene, such as that sold under the trade name STYROFOAM®, EIFS, "Dens-Shield", rigid sheet plastic, drywall or sheetrock.
3. Mastic or thinset mortar is spread over the base board 22 and the surface board 20 is laminated to it by clamping and pressing the two together, forming a single rigid base.
4. Edge strip boards 26, which are small strips of surface board, are attached with mastic or thinset mortars covering all the base edges where the base board 22 and the surface board 20 are joined and that would be exposed for tiling.
5. Self adhesive drywall crack tape 28, which is a fine fiberglass mesh strip treated with adhesive, is applied to all exposed substrate joints.
6. Finally, the tiles 9, 10, are set and grouted in place, if an inset sink 7 such as shown in FIG. 1 is to be installed, the sink cutout 24 on the surface board 20 will be larger than the cutout on the base board 22, allowing the sink to fit in and drop onto a ledge, placing it ½ in. to ¾ in. below the top surface of the tiles 9. Appropriate tile trim units can then be grouted in place to cover the exposed sink rim and to complete the counter top.

A top set sink may be installed in the counter top either at the time of tiling or at a later time.

Figure 5A:
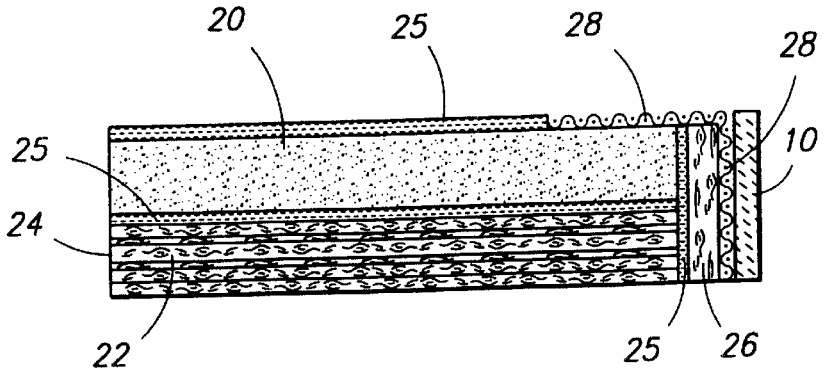
FIG. 5A is a cross-section view of a counter taken along line 5—5 of FIG. 4, showing the component parts and layers comprising a substrate.

FIG. 5A is a cross-section view of the preferred embodiment counter top 1, taken along line 5—5 of FIG. 4. It clearly shows the result of the counter top production steps briefly described above, excepting the installation of the top tiles. The mastic or thinset adhesive layers 25 are shown in place as is the crack tape 28. The substrate assembly so described, is rigid and strong enough to support the weight of the tiles and any normally expected weight to be placed on the counter without bending or cracking. As with all tiled counter tops that are presently fabricated and installed at a customer's site, a complete pre-fabricated counter top 1 must be properly supported by the cabinet on which it is installed.

Figure 5B:
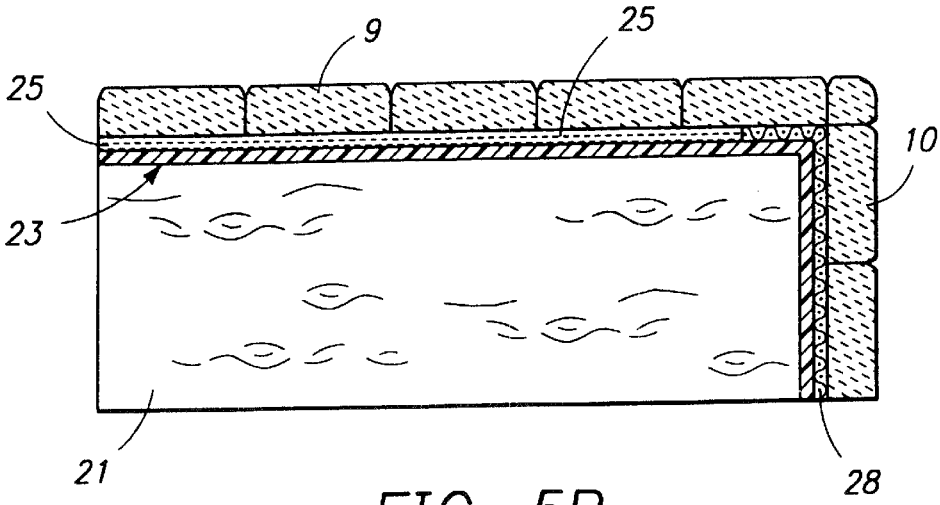
FIG. 5B is a cross-section view of an embodiment counter, fully assembled with tiles installed.

Refer now to FIG. 5B. This is a cross-section of an alternate embodiment counter top 1. Starting from the bottom, the components comprise a rigid wood sheet base board 21, a waterproof membrane sheet 23 covering the top and sides of the base board 21, self-adhesive drywall crack tape 28, mastic or thinset mortar 25 which is spread over the substrate top surface and crack tape, and tiles 9 set and grouted on the top surface and on the sides 10.

A waterproof membrane 23 is required to protect the wood base board from any spilled liquid that may enter through cracks in the tiles. The base board 21 may be a plywood sheet or any other rigid wood panel, so long as it has the requisite dimensions and strength.

Another alternate embodiment counter top 1 would be the use of a single, solid piece of a rigid foam polystyrene, such as that sold under the trade name STYROFOAM® or plastic, that is tiled and grouted, and ready to install on a cabinet.

Figure 6:
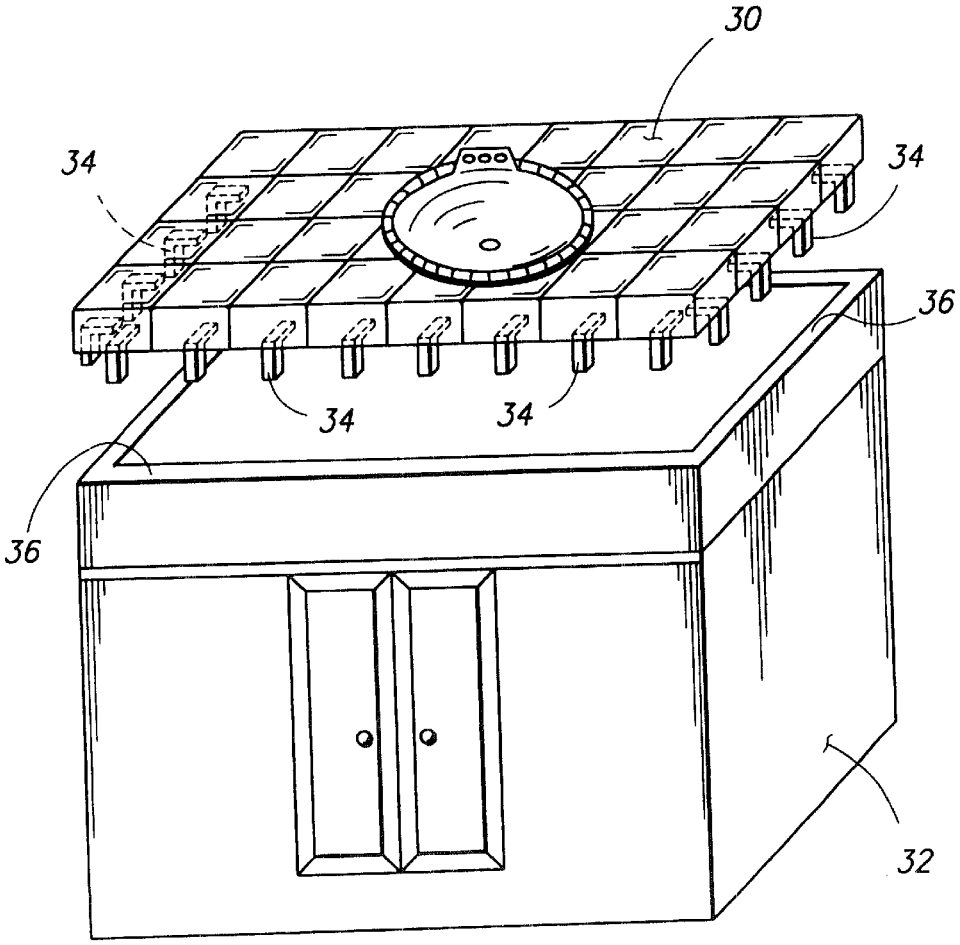
FIG. 6 is a perspective view of another embodiment of the invention illustrating a complete counter top in position for installing on a cabinet, particularly showing L-shaped brackets attached to the counter bottom.

For installing a pre-fabricated complete counter top 1 such as shown in FIG. 1 on a cabinet in a kitchen or bathroom, the counter top would usually be placed on the cabinet and adhered from below with adhesives and caulking material. However, when used for bathroom vanity tops, which is an ideal application, the counter top would need some means of preventing it being shifted laterally off a vanity cabinet. Such a means is illustrated in FIG. 6.

A vanity cabinet 32 is usually constructed having top edges defining a rim 36 around the cabinet top to support a counter top. For this application, the pre-fabricated counter top 30 would include a number of L-shaped brackets 34 that are fixed to the bottom surface of the counter 30, located spaced apart around the counter perimeter. For installation, caulking is placed on the upper edges 36 of the cabinet and the counter top is simply laid upon the cabinet and adhered to it. The brackets will effectively prevent any lateral shifting of the counter top with respect to the cabinet, in addition, if a topset sink is used, its attachment would also help secure the counter top in place.

It will be appreciated that other well known interference members may be used without detracting from the scope of the present invention. Additionally, such interference members could be attached to the cabinet for additional security.

Finally, there are some applications where the required counter tops and/or splash panels are very long. For these applications, it wold be necessary to split the counter top and/or splash panels into two or more completed sections.

Figure 7:
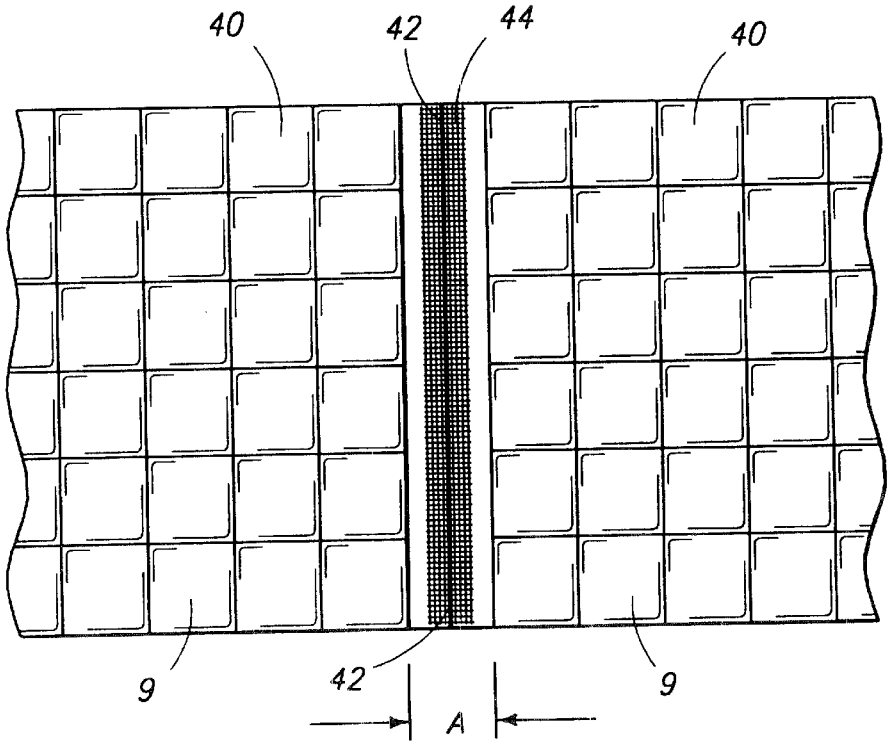
FIG. 7 is a partial plan view of another embodiment of the present invention illustrating two counter sections attached at their joining edge by a taped adhesive.

FIG. 7 illustrates the recommended method of joining these completed sections when they are installed. The counter top or splash panel sections 40 are tiled 9 leaving an untiled space at the section edge 42 which is to be joined. When the sections are installed on a cabinet or wall surface and place edge 42 to edge as shown in FIG. 7, it will leave a space "A" one tile wide between the tiled areas. It is not necessary that the tile width is evenly distributed across the joined edges. The edges 42 are covered with a strip of self-adhesive drywall crack tape 44 and filled and coated with a fast-setting joint compound. After allowing time for the joint to dry, tiles are grouted in place to cover the untiled edge area, and installation of the sections is finished.

The invention counter top and splash panels would be ideal for do-it-yourselfer's as it would be relatively simple to install. The product would eliminate the present need to locate tile-setters, get quotations, have a tile-setter come to the home and hope the workmanship was up to standard. With this product easily available, the workmanship would be known at the time of purchase by the homeowner, and the counter top and splash panels could be installed by a cabinet installer, a plumber or a homeowner. There should also be a cost benefit to the homeowner as well as a minimum of mess to be cleaned up and a minimum of inconvenience and time delays. For example, a small counter could be installed in about an hour.

Builders will also benefit from this as they could greatly reduce the need for skilled tile-setters and the time consuming and messy operation that this type of work normally involves, it would also reduce the occurrence of unsatisfactory workmanship as the builder too would be able to view the complete counter and splash panels before they were installed at a site.

The cost of the completed product would be substantially less to a builder than the present day methods of installing tiled counter, and the impact to a construction schedule would be significantly improved.

From the above description it is clear that the embodiments of the present invention provide several advantages over other previous solutions. Alternative embodiments and various modifications may be apparent to those skilled in the art. These alternatives and modifications are considered to be within the spirit and scope of the present invention.

Having described the invention, what is claimed is:

1. A transportable, prefabricated tiled counter top assembly for convenient installation on a cabinet having a mounting rim, the counter top comprising:

at least one elongated, laminated, frameless, substrate body having a base board member, a surface board member, and a first adhesive layer sandwiched between said board members, said body being formed to fit on said cabinet and providing a top surface and at least one edge surface, said top and edge surfaces forming an exposed tile adhesion region, and a bottom mounting surface for complementally attaching to said mounting rim;

a second adhesive layer coating said tile adhesion region; and a plurality of tiles arranged in a predetermined pattern in covering relationship with said second adhesive layer whereby said tiled counter top may be assembled at an assembly site and transported to a permanent installation site to be installed on the cabinet using a preselected adhesive material applied between the bottom surface of said body and said mounting rim.

2. The counter top as set forth in claim 1 further including:

at least one splash panel including a backing board having a lowermost edge and a tile supporting surface, a layer of tile adhesive coating said tile supporting surface, and a layer of tiles affixed to said tile adhesive coating and, whereupon installation of said splash panel and said substrate body, said splash panel is positioned with said layer of tiles facing said substrate body and said lowermost edge is placed substantially proximate to an edge of said substrate body to form a joint to be filled with a filling material.

3. The counter top as set forth in claim 1 wherein:

said tile adhesion region includes at least one trim region requiring non-uniformly sized tiles; and at least one trim tile affixed to said second adhesive in said trim region.

4. The counter top as set forth in claim 1 wherein:

said body includes at least one cutout extending between said top and bottom surfaces for placing a sink therein.

5. The counter top as set forth in claim 1 wherein:

said base board material is wood, plastic, or rigid foam polystyrene.

6. The counter top as set forth in claim 1 wherein:

said surface board material is cement board, greenboard, coated polystyrene, acrylic coated tile-backer material, rigid sheet plastic, sheetrock, EIFS, drywall, or rigid foam polystyrene.

7. The counter top as set forth in claim 1 wherein:

said first adhesive is comprised of cementitious material.

8. The counter top as set forth in claim 1 wherein:

said second adhesive is thinset mortar or mastic.

9. The counter top as set forth in claim 1 further including:

an interference member attached to said bottom surface of said substrate body for preventing said substrate body from shifting relative to the cabinet in a predetermined direction.

10. The counter top as set forth in claim 1 further including:

at least two elongated substrate bodies placed in end to end abutting relationship to form between the ends thereof an exposed joint; and said joint is covered by a taper material.

11. The counter top as set forth in claim 1 further including:

at least one edge strip sized to match the thickness of said substrate body and affixed to said substrate body and disposed between said edge surface and said second adhesive.

12. The counter top as set forth in claim 1 further including:

a waterproof membrane sheet covering the top surface of said base board.

13. The counter top as set forth in claim 1 wherein:

said tiles are ceramic, stone, thinbrick, quarry, concrete, or simulated stone.

14. A transportable prefabricated tiled and grouted counter top for convenient installation on a cabinet having a mounting region with a predetermined configuration, the counter top comprising:

a single layer rigid base slab constructed to support its own weight without an external frame and having a top surface and at least one edge surface forming an exposed tile adhesion region, and a bottom surface providing a mounting surface complementing the predetermined configuration of cabinet's mounting region;

an adhesive layer coating said exposed tile adhesion region; and a plurality of tiles arranged in a predetermined pattern in covering relationship with said adhesive layer and adhered thereto whereby said counter top may be assembled at an assembly site, transported to the site of said cabinet without requiring any framework, and installed thereon.

15. The counter top as set forth in claim 14 wherein:

said base slab is formed of a foam polystyrene material.

16. The counter top as set forth in claim 14 wherein:

said base slab is formed of a plastic material.

17. A transportable, prefabricated tiled counter top assembly for convenient installation on a cabinet having a mounting rim, the counter top comprising:

an elongated frameless substrate body constructed to support its own weight and including an upper surface and at least one edge surface forming an exposed tile adhesion region, said body further including a bottom mounting surface for complementally mounting to said mounting rim;

an adhesive layer applied directly to said exposed tile adhesion region; and a plurality of tiles arranged in a predetermined pattern in a covering relationship with said adhesive layer whereby said tiled counter top may be assembled at an assembly site and transported to a permanent installation to be installed on the cabinet by mounting said bottom mounting surface to said mounting rim.

* * * * *